United States Patent [19]

Fletcher et al.

[11] Patent Number: 4,465,564

[45] Date of Patent: Aug. 14, 1984

[54] GOLD PLATING BATH CONTAINING TARTRATE AND CARBONATE SALTS

[75] Inventors: Augustus Fletcher, Bristol, Conn.; David N. Cockayne, FanLing, Hong Kong; William L. Moriarty, South Meriden, Conn.

[73] Assignee: American Chemical & Refining Company, Inc., Waterbury, Conn.

[21] Appl. No.: 507,763

[22] Filed: Jun. 27, 1983

[51] Int. Cl.[3] ..... C25D 3/48; C25D 3/62

[52] U.S. Cl. ..... 204/44; 204/43 G; 204/DIG. 9

[58] Field of Search ..... 204/43 G, 46 G, 109, 204/123, 44, DIG. 9

[56] References Cited

U.S. PATENT DOCUMENTS

| | | | |
|---|---|---|---|
| 1,785,389 | 12/1930 | Piersol | 204/228 |
| 2,555,375 | 6/1951 | Ruemmler | 204/43 R |
| 2,724,687 | 11/1955 | Spreter et al. | 204/43 G |
| 2,905,601 | 9/1959 | Rinker | 204/43 G |
| 2,967,135 | 1/1961 | Ostrow et al. | 204/43 G |
| 3,104,212 | 9/1963 | Rinker et al. | 204/46 G |
| 3,219,558 | 11/1965 | Gardner | 204/46 G |
| 3,362,895 | 1/1968 | Gardner | 204/43 R |
| 3,397,127 | 8/1968 | Camp | 204/46 G |
| 3,475,292 | 10/1969 | Shoushanian | 204/44 |
| 3,475,293 | 10/1969 | Haynes | 204/48 |
| 3,598,706 | 8/1971 | Freedman et al. | 204/46 G |
| 3,661,734 | 5/1972 | Sloan | 204/52 Y |
| 3,666,640 | 5/1972 | Smith | 204/44 |
| 3,749,650 | 7/1973 | Dettke et al. | 204/44 |
| 3,893,896 | 7/1975 | Korbelak et al. | 204/44 |
| 3,926,748 | 12/1975 | Lerner | 204/43 G |
| 4,121,982 | 10/1978 | Moriarty et al. | 204/43 G |

FOREIGN PATENT DOCUMENTS

| | | | |
|---|---|---|---|
| 234813 | 4/1969 | U.S.S.R. | 204/46 G |

OTHER PUBLICATIONS

V. A. Lamb, Plating, pp. 909–913, Aug. 1969.

*Primary Examiner*—G. L. Kaplan

[57] ABSTRACT

A bath for electrodepositing gold utilizes, as the essential ingredients of its electrolyte, salts providing the tartrate radical and the carbonate radical. The bath will have a pH value ranging from approximately neutral to highly alkaline, and adjustments to lower the pH will most advantageously be made utilizing tartaric acid. The bath operates with relatively low gold concentrations, and is capable of producing highly pure deposits and highly desirable alloy deposits; it is especially well suited for semi-conductor industry applications.

15 Claims, No Drawings

GOLD PLATING BATH CONTAINING TARTRATE AND CARBONATE SALTS

BACKGROUND OF THE INVENTION

The present invention concerns a novel bath and method for electroplating high-purity gold and various gold alloys. Typically, such deposits are produced from baths that contain the cyanide and/or the phosphate radical, although other electrolytes, such as those which are based upon the citrate radical, have certainly been used to good advantage. It is of course common to add brighteners, hardeners, chelating agents, and other ingredients to such solutions to provide a variety of modifications in the nature of the deposit and improvements in the operating characteristics of the bath.

The prior art shows the inclusion of carbonate compounds and tartrate compounds in gold plating baths for a variety of purposes. In Spreter et al U.S. Pat. No. 2,724,687, for example, the use of potassium carbonate is disclosed for pH adjustment in a gold alloy bath. An acid gold bath containing tartaric acid and a base metal tartrate salt is taught in Rinker et al U.S. Pat. No. 2,905,601, and acid gold baths containing tartaric acid are disclosed both in Ostrow et al U.S. Pat. No. 2,967,135 and also in Rinker et al U.S. Pat. No. 3,104,212.

A tartaric acid-containing gold plating bath, which may be operated at a pH of 6.1 to 10.5, is disclosed in Camp U.S. Pat. No. 3,397,127, and Shoushanian U.S. Pat. No. 3,475,292 teaches the use of potassium carbonate or potassium tartrate as a buffering and conducting salt in a gold plating bath operated at a pH of 8 to 12 or higher. Haynes et al U.S. Pat. No. 3,475,293 discloses the use of potassium carbonate in a variety of metal baths, Freedman et al. U.S. Pat. No. 3,598,706 teaches the inclusion of tartrates in acid gold plating baths, and Smith U.S. Pat. No. 3,666,640 utilizes tartaric acid as a chelating agent in a gold sulfite formulation.

In U.S. Pat. No. 3,893,896, Korbelak et al teach a gold plating solution containing, among other ingredients, an alkali gold cyanide, a weak aliphatic acid, a non-depositing metallic compound, and a metallic hardener. The weak acid may be tartaric, the non-depositing metal may be introduced as a carbonate compound, and the metal hardener may be added as the tartrate; the pH range of the bath is disclosed to be about 3.7 to 4.8. Lerner U.S. Pat. No. 3,926,748 teaches a neutral gold and antimony bath, which includes potassium tartrate and antimony potassium tartrate. The incorporation of alkali metal tartrates in a gold alloy bath that operates at a pH between about 8 and 10 is disclosed in Moriarty et al U.S. Pat. No. 4,121,982.

The prior art also teaches the use of the tartrate and carbonate compounds in silver plating baths. In particular, such formulations are disclosed in Ruemmler U.S. Pat. No. 2,555,375. Similarly, the combination of tartar emetic and potassium carbonate for plating silver from a cyanide bath is taught by Gardner in U.S. Pat. No. 3,219,558, and he discloses in U.S. Pat. No. 3,362,895 using antimony potassium tartrate in a weak acid/salt combination, as a buffering system in a neutral silver bath.

Despite the foregoing, a demand exists for a gold plating bath that is capable of producing electrodeposits of high purity, and particularly one that is capable of producing deposits of sufficient purity to meet the requirements of the semi-conductor industry, using either continuous or pulsed direct current. A need also exists for such a bath of relatively low specific gravity, which is capable of operating under high current density plating conditions at relatively low gold concentrations, and which has a high tolerance to contamination, such as from copper. Finally, there is a demand for a bath having the foregoing features asd advantages, from which gold can be alloyed with various metals to produce a variety of characteristics in the deposit, and to extend the range of brightness exhibited thereby.

Accordingly, it is a primary object of the present invention to provide a novel plating bath which is capable of producing highly pure gold electrodeposits, and a novel method utilizing the same.

It is also an object of the invention to provide such a novel bath and method in which the bath is capable of operating under high current density plating conditions, and is of relatively low gold concentration and specific gravity.

It is a more specific object of the invention to provide such a bath and method which are capable of producing electrodeposits of sufficient purity to meet the requirements of the semi-conductor industry.

It is a further object of the invention to provide such a bath which has a high tolerance to contamination, and which can produce gold alloy deposits of varying karat values and of extended brightness range.

SUMMARY OF THE INVENTION

It has now been found that the foregoing and related objects of the present invention are readily attained by the provision of an aqueous gold plating bath comprising, on a per liter basis: about 0.005 to 0.2 gram mole of gold in solution; a tartrate salt providing about 0.1 to 0.4 gram mole of tartrate radical; and a carbonate salt or acid salt providing about 0.2 to 1.5 gram moles of carbonate radical, the bath having a pH of about 7.5 to 13.0. In the preferred embodiments, the concentration of gold will be about 0.02 to 0.06 gram mole; the concentration of the tartrate salt will provide about 0.2 to 0.3 gram mole of tartrate radical; and the concentration of the carbonate salt or acid salt will provide about 0.2 to 0.7 or 1.0 to 1.5 gram mole of the carbonate radical, respectively; and the pH value will be about 8.0 to 11.0.

In other embodiments the bath may include, in addition to the foregoing ingredients, suitable amounts of metallic additives, such as may be selected from the group consisting of thallium, arsenic, copper, cadium, zinc, and palladium, and mixtures thereof. Other additives may also be employed, such as polyethyleneimine, potassium cyanide, and sodium borate. Any reduction of bath pH that is to be made will most desirably be effected using tartaric acid.

Additional objects of the invention are achieved by the provision of a novel method for electroplating gold, in which the workpiece is immersed in a bath having the composition hereinabove set forth. The temperature of the bath will be mantained at about 35° to 85° Centigrade, and an electrical potential will be applied across the workpiece and an anode to provide a current density of about 0.1 to 2500 amperes per square foot at the workpiece, to thereby effect the desired thickness of the electrodeposited metal; preferably, the temperature of the bath will not exceed about 70° Centigrade, and the current density will be about 1.0 to 750 ASF.

DETAILED DESCRIPTION OF THE PREFERRED EMBODIMENTS

As is conventional practice, the gold will usually be introduced into solution as a soluble gold cyanide, and most generally as the potassium salt. A sufficient amount of the gold compound will be dissolved to provide about 1 to 37.5 grams of metal (0.005 to 0.2 gram mole) per liter of solution; in the preferred baths, the concentration of gold will range from about 4 to 12 grams (0.02 to 0.06 gram mole) per liter.

While it will not generally be necessary to maintain free cyanide in the bath, doing so will often be beneficial. When used, the concentration of free cyanide will depend primarily upon the acidity of the bath, and will range from about 2.0 to 30.0 grams per liter of potassium cyanide, in roughly direct proportion to pH values of about 7.5 to 13.0.

The main electrolyte ingredients of the bath are the carbonate and tartrate salts. Although sodium and ammonium derivatives may utilized, most generally the potassium compounds will constitute the source of these radicals. Carbonate radical may be introduced either in the form of the salt or the acid salt; e.g., as either potassium carbonate or potassium bicarbonate. The amount of tartrate salt employed should be sufficient to provide about 0.1 to 0.4, and preferably about 0.2 to 0.3, gram mole per liter of the tartrate radical. The carbonate salt will be used in a concentration sufficient to provide about 0.2 to 0.7 gram mole per liter of carbonate radical, whereas the acid salt will normally provide about 1.0 to 1.5 gram moles per liter thereof.

In the event that the pH of the bath is excessively high for proper operation, tartaric acid will desirably be utilized to lower its value, since doing so avoids the introduction of any extraneous interfering ions. If, on the other hand, the pH is lower than desired, it will generally be elevated by adding an appropriate amount of potassium hydroxide.

As mentioned above, metals in addition to gold may advantageously be included in the bath of the invention. The metals most commonly employed will include thallium (about 0.005 to 0.1 gram per liter), arsenic (about 0.005 to 0.1 gram liter), copper (about 0.15 to 5.0 grams per liter), cadmium (about 0.05 to 5 grams per liter), zinc (about 0.05 to 5 grams per liter), and palladium (about 0.10 to 5 grams per liter); frequently combinations of two or more of such additives metals will produce desired deposits. In general, the bath can be utilized to produce approximately 18 karat deposits by alloying the gold with cadmium and copper; it can be used to produce 20 to 22 karat gold deposits by alloying with copper and palladium; and it can be alloyed with arsenic and/or thallium to substantially extend the range of current densities in which a bright deposit will be produced. Sodium borate may also be added to the bath to increase the bright range, and typically about 30 grams per liter will be most effective. The addition of polyethyleneimine, particularly in combination with one or more of the foregoing alloying metals, has also been found to afford improved results; typically, it will be used in a concentration of about 5 to 40 milliliters of a 16 gram per liter concentrate, and preferably about 20 milliliters thereof, per liter of solution.

The bath of the invention will operate to produce desirable deposits in a relatively broad pH range, the limits of which extend from approximately neutral to strongly alkaline; the preferred range is about 8.0 to 11.0. The specific gravity of the bath will generally be from about 6° to 12° Baume, although considerably higher values may be maintained, particularly when the electrolyte is comprised of a bicarbonate acid salt. Although in certain instances the bath of the invention may operate at a current density as high as 2500 amperes per square foot, normally the applied voltage will produce a current density at the workpiece of about 1.0–750 ASF. While temperatures may vary in the bath from about 35° to 85° Centigrade, the preferred value will generally be about 60° to 70° Centigrade.

Various types of plating apparatus may be employed in connection with the compositions and methods of the present invention, including equipment for barrel and rack plating, and for high speed continuous selective plating. In addition to steady direct current plating, pulse plating can be employed to produce good quality, non-porous deposits at relatively high speeds with the least amount of gold content.

Various anodes may be used in the electroplating operation, including gold, stainless steel, platinum, platinum-clad tantalum and graphite. The material from which the tank or other vessel is fabricated should be inert to the bath, and polypropylene, rubber-lined steel, polyvinyl chloride or other suitable materials are desirably employed. The bath should be filtered and aggitated during operation to avoid difficulties and to obtain optimum operation.

Exemplary of the efficacy of the present invention are the following specific examples, wherein all parts are on a weight basis unles otherwise indicated. Hardnesses are expressed as Knoop values, and represent the average number of several tests using a 25 gram indenting tool; temperatures are in Centigrade degrees, and specific gravities are expressed in Baume degrees. All baths described are based upon one liter of solution, and are formulated with deionized water; gold is added as 68 percent potassium gold cyanide.

EXAMPLE ONE

A solution is prepared to have the following composition and features:

| Component/Feature | Amount/Value |
|---|---|
| Potassium Tartrate | 30 g |
| Potassium Carbonate | 30 g |
| Gold Metal | 6.01 g |
| pH | 11.0 |
| Temperature | 50° |
| Specific Gravity | 6° |

A. Using the foregoing solution, Kovar lead frames are plated in a laboratory spot plater at about 187 ASF for 10 seconds, with the following results:

| | |
|---|---|
| Color of deposits | Semi-bright yellow |
| Thickness | 1.55 micrometers |
| Efficiency | 102 mg/amp min. |

B. The pH of the bath is adjusted to 8.5 using d-tartaric acid, and Kovar lead frames are again plated at 187 ASF for 7 seconds, with the following results:

| | |
|---|---|
| Color of deposits | Semi-bright yellow |
| Thickness | 1.04 micrometers |

-continued

| | |
|---|---|
| Efficiency | 87 mg/amp min. |

C. The pH of the bath is further adjusted to 6.5 with d-tartaric acid, and the test of part B is repeated, with the following results:

| | |
|---|---|
| Color of deposits | Semi-bright yellow |
| Thickness | 1.13 micrometers |
| Efficiency | 93.99 mg/amp min. |

EXAMPLE TWO

Solutions are prepared containing 1.5 gram of d-tartaric acid, either 30 or 60 grams (each) of both potassium tartrate and potassium carbonate, and various amounts of gold. The specific gravity of the bath containing the two electrolytes at the 30 g/l concentration is 6.4° Baume; that of the 60 g/l bath is 12°, and all baths have pH values of 8.5. Standard Hull cell tests are carried out at 0.5 ampere for 2.0 minutes with the bath at 65.5° Centigrade, with the following results:

| | Gold | Bright Range | Efficiency |
|---|---|---|---|
| A. | 4.0 g/l | 0–0.5 ASF | 99.0 mg/amp min. |
| B. | 4.0 g/l | 0–2.5 ASF | 114.0 mg/amp min. |
| C. | 6.0 g/l | 0–12.5 ASF | 118.0 mg/amp min. |
| D. | 8.0 g/l | 0–7.0 ASF | 110.0 mg/amp min. |
| E. | 8.0 G/L | 0–9.0 ASF | 110.0 mg/amp min. |
| F. | 8.0 g/l | 0–20 ASF | 116.0 mg/amp min. |

The solution designated "F" has the same composition as "E", with the exception that it additionally contains 30 grams of sodium borate.

EXAMPLE THREE

A solution is prepared having the following composition and features:

| Component/Feature | Amount/Value |
|---|---|
| Potassium Tartrate | 60 g |
| Potassium Carbonate | 60 g |
| D-Tartaric Acid | 1.5 g |
| Gold Metal | 8.2 g |
| Temperature | 65.5° |
| Specific Gravity | 12° |

A. In the above-defined bath, a 1×2 inch platinum coupon and a 1×2 inch brass coupon are simutaneously plated for a period of 164 minutes at 3 ASF, to obtain a deposit that is 48 micrometers thick. The hardness and purity of the deposit are determined to have the following values:

| | |
|---|---|
| Hardness | Knoop 25 = 77 |
| Purity | Gold = 99.99% |

B. The same bath is contaminated by adding 0.050 g/l of copper metal (as potassium coper cyanide) and the foregoing tests are repeated, with the following results:

| | |
|---|---|
| Hardness | Knoop 25 = 77 |
| Purity | Gold = 99.999% |

-continued

| | |
|---|---|
| | Copper = 0.0004% |

C. The bath is further contaminated to a level of 0.100 g/l of copper and tested, with the following results:

| | |
|---|---|
| Hardness | Knoop 25 = 88 |
| Purity | Gold = 99.995% |
| | Copper = 0.005% |

D. At 0.150 g/l of copper, the results of testing are:

| | |
|---|---|
| Hardness | Knoop 25 = 82 |
| Purity | Gold = 99.782% |
| | Copper = 0.214% |

EXAMPLE FOUR

A bath is prepared to have the following composition and features:

| Component/Feature | Amount/Value |
|---|---|
| Potassium Tartrate | 60 g |
| Potassium Bicarbonate | 120 g |
| Specific Gravity | 16.2° |
| pH | 7.76 |
| Gold Metal | 8.2 g |

The results of Hull cell tests, run at the temperature indicated and 0.5 ampere for 2.0 minutes, are as follows:

| Temperature | Bright Range | Efficiency |
|---|---|---|
| 49° C. | 0–4.5 ASF | 112 mg/Amp Min. |
| 65.5° C. | 0–15.0 ASF | 120 mg/Amp Min. |

EXAMPLE FIVE

A bath is prepared to have the following composition and features:

| Component/Feature | Amount/Value |
|---|---|
| Potassium Tartrate | 60 g |
| Potassium Carbonate | 60 g |
| D-Tartaric Acid | 1.5 g |
| Gold Metal | 12.02 g |
| pH | 8.5 |
| Specific Gravity | 12° |
| Temperature | 65.5° |

A. The following results are obtained in Hull cell tests run at 0.5 ampere for 2.0 minutes, with the foregoing bath modified as indicated:

| Additive | Bright Range | Efficiency |
|---|---|---|
| 20 ppm Arsenic | 0–20+ ASF | 117 mg/Amp Min. |
| 20 ppm Thallium | 0–12.5 ASF | 119 mg/Amp Min. |

Arsenic is added as sodium arsenite and thallium is added as thallium nitrate; the weight (in parts per million) is based upon the weight of one liter of solution.

B. Using the baths of part A, coupons are electroplated as described in Example Three A above, with the following results:

| Arsenic Modified | |
|---|---|
| Hardness | Knoop 25 = 96.6 |
| Purity | Gold = 99.96% |
| | Arsenic = 0.031% |

| Thallium Modified | |
|---|---|
| Hardness | Knoop 25 = 123.5 |
| Purity | Gold = 99.56% |
| | Thallium = 0.43% |

C. Adjustments to the pH of the unmodified bath are made with tartaric acid and potassium hydroxide, as appropriate, and plating is carried out in a Hull cell for 2 minutes at 0.5 ampere, to produce the following results:

| pH | Bright Range | Efficiency |
|---|---|---|
| *6.5 | 0–15 ASF | 115 mg/Amp min. |
| 7.5 | 0–13.5 ASF | 115 mg/Amp min. |
| 8.5 | 0–15 ASF | 113 mg/Amp min. |
| 9.5 | 0–12.5 ASF | 115 mg/Amp min. |

*bath pH rose to pH 7.5 after test

D. The basic bath is modified with various combinations of copper, cadmium, palladium, zinc and polyethyleneimine to demonstrate the desirability of incorporating those additives; most notable are combinations of copper, cadmium and polyethyleneimine, and of copper and palladium.

EXAMPLE SIX

The uncontaminated bath of Example Three above is tested for use in producing a semi-conductor package in which a silicon chip is bonded by heat and pressure to a gold electroplated surface, and the leads are electrically connected from the gold plated surface to the silicon chip by thermo-sonic or ultrasonic means. In the test, the surface for bonding is first plated with nickel from a sulfamate solution to a thickness of 1.25 micrometers, and is then plated in the gold bath to produce a 1.5 micrometer deposit, using either pulsed or non-pulsed DC current (average current density of 3 ASF). The resultant packages are subjected to standard wire bond test procedures used in the semi-conductor industry, involving evaluation of the assemblies in the "as plated" condition as well as after heat cycling at different temperatures and for varying periods, and satisfy all applicable criteria.

Thus, it can be seen that the present invention provides a novel electroplating bath which is capable of producing highly pure gold deposits, and a novel method utilizing the same. The bath is capable of operating under high current density plating conditions, and is of relatively low gold concentration and specific gravity. It also has a high tolerance to contamination, and is capable of producing gold alloy deposits of varying karat values and of extended brightness range.

Having thus described the invention, what is claimed is:

1. An aqueous gold plating bath comprising, on a per liter basis: about 0.005 to 0.2 gram mole of gold in solution; a tartrate salt providing about 0.1 to 0.4 gram mole of tartrate radical; and a carbonate salt or acid salt providing about 0.2 to 1.5 gram moles of carbonate radical, said bath having a pH of about 7.5 to 13.0.

2. The bath of claim 1 wherein the concentration of gold in solution is about 0.02 to 0.06 gram mole, the concentration of the tartrate salt provides about 0.2 to 0.3 gram mole of the tartrate radical, the concentration of the carbonate salt provides about 0.2 to 0.7 gram mole of the carbonate radical, and said pH value is about 8.0 to 11.0.

3. The bath of claim 1 wherein the concentration of gold in solution is about 0.02 to 0.06 gram mole, the concentration of the tartrate salt provides about 0.2 to 0.3 gram mole of the tartrate radical, the concentration of the carbonate salt provides about 1.0 to 1.5 gram mole of the carbonate radical, and said pH value is about 8.0 to 11.0.

4. The bath of claim 1 additionally comprising a minor amount of a metallic additive selected from the group consisting of thallium, arsenic, copper, cadmium, zinc, palladium, and mixtures thereof.

5. The bath of claim 4 additionally including an additive selected from the group consisting of polyethyleneimine, potassium cyanide, sodium borate, and mixtures thereof.

6. The bath of claim 1 additionally including an additive selected from the group consisting of polyethyleneimine, potassium cyanide, sodium borate, and mixtures thereof.

7. A method for electroplating gold comprising the steps of:

A. immersing a workpiece in a bath comprising, on a per liter basis, about 0.005 to 0.2 gram mole of gold in solution, a tartrate salt providing about 0.1 to 0.4 gram mole of tartrate radical, a carbonate salt providing about 0.2 to 1.5 gram mole of carbonate radical, said bath having a pH value of about 7.5 to 13.0 and a temperature of about 35° to 85° C.; and B. applying an electrical potential across the workpiece and an anode to provide a current density of about 1.0 to 750 amperes per square foot at said workpiece, to thereby effect the desired thickness of electrodeposited metal thereon.

8. The method of claim 7 wherein said potential is applied by continuous direct current.

9. The method of claim 7 wherein said potential is applied by pulsed direct current.

10. The method of claim 7 including the additional step of adjusting the pH to said value by the introduction of tartaric acid into said bath.

11. As a gold electroplating bath, a solution consisting essentially of about 30 to 60 grams of potassium tartrate, about 30 to 60 grams of potassium carbonate, about 1.5 grams of tartaric acid, about 8 to 12 grams of gold metal, zero to 30 grams of potassium cyanide, zero or an effective amount of an additive selected from the group consisting of thallium, arsenic, copper, cadmium, zinc, palladium, sodium borate, polyethyleneimine, and mixtures thereof, and sufficient water to form one liter of solution.

12. The bath of claim 11 from which potassium cyanide is omitted, and in which the amounts of potassium tartrate and potassium carbonate included are both 60 grams.

13. The bath of claim 11 in which said additive comprises copper, cadmium, and polyethyleneimine, in combination.

14. The bath of claim 11 in which said additive comprises copper and palladium, in combination.

15. As a gold electroplating bath, a solution consisting essentially of about 60 grams of potassium tartrate, about 120 grams of potassium carbonate, about 8 grams of gold metal, and sufficient water to form one liter of solution.

* * * * *